United States Patent [19]

Hasebe et al.

[11] Patent Number: 4,750,461

[45] Date of Patent: Jun. 14, 1988

[54] IDLING SPEED CONTROL SYSTEM FOR INTERNAL COMBUSTION ENGINES

[75] Inventors: Hiroshi Hasebe, Hatogaya; Masahiko Asakura, Tokorozawa; Michio Sakaino, Fujimi; Yukio Miyashita, Hannou, all of Japan

[73] Assignee: Honda Giken Kogyo K.K., Tokyo, Japan

[21] Appl. No.: 880,727

[22] Filed: Jul. 1, 1986

[30] Foreign Application Priority Data

Jul. 5, 1985 [JP] Japan ..... 60-146606

[51] Int. Cl.[4] ..... F02N 3/06

[52] U.S. Cl. ..... 123/339; 123/352

[58] Field of Search ..... 123/339, 340, 352

[56] References Cited

U.S. PATENT DOCUMENTS

| | | | |
|---|---|---|---|
| 3,356,081 | 12/1967 | Dennis | 123/354 |
| 4,086,888 | 5/1978 | Roberts | 123/354 |
| 4,441,471 | 4/1984 | Kratt | 123/339 |
| 4,522,175 | 6/1985 | Kamifuji | 123/339 |
| 4,524,739 | 6/1985 | Kashiwaya | 123/339 |
| 4,546,744 | 10/1985 | Bonfigioli | 123/339 |
| 4,554,899 | 11/1985 | Engel | 123/339 |

*Primary Examiner*—Ronald B. Cox
*Attorney, Agent, or Firm*—Arthur L. Lessler

[57] ABSTRACT

An idling speed control system for controlling idling rotational speed of an internal combustion engine. A vacuum-operated actuator having a diaphragm defining a vacuum chamber controls opening and closing of a throttle valve in an intake passage of the engine in response to first and second control pressures supplied from a change-over control valve to the vacuum chamber. An electronic control unit generates an on-off control pulse signal having a period corresponding to the rotational speed of the engine, one of on-period and off-period of the on-off control pulse signal having a predetermined constant value, and supplies the change-over control valve with the on-off control pulse signal, in response to which the change-over control valve supplies the vacuum chamber of the vacuum-operated actuator, selectively, with the first control pressure and the second control pressure, determines the engine rotational speed and a rate of decrease in the engine rotational speed, and halts the control for a predetermined period of time when the determined engine rotational speed falls within a predetermined range and at the same time the determined rate of decrease in the engine rotational speeds falls within a predetermined range.

8 Claims, 3 Drawing Sheets

FIG.3
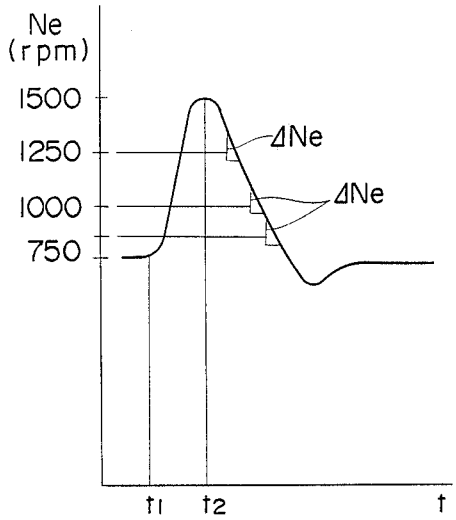
FIG.6
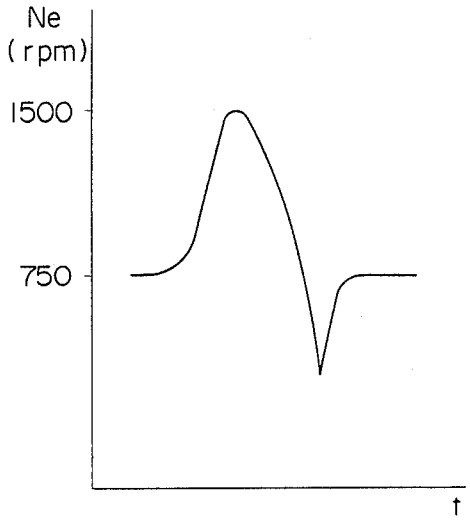
FIG.4
| Ne ≦ 850 rpm | | 1000 rpm ≧ Ne > 850 rpm | | 1250 rpm ≧ Ne > 1000 rpm | |
|---|---|---|---|---|---|
| −ΔNe rpm | ONESHOT TIME msec | −ΔNe rpm | ONESHOT TIME msec | −ΔNe rpm | ONESHOT TIME msec |
| 25 | 0 | 15 | 0 | 12 | 0 |
| | 30 | | 100 | | 200 |
| 28 | | 20 | | 16 | |
| | 60 | | 150 | | 250 |
| 31 | | 25 | | 20 | |
| | 100 | | 200 | | 300 |
| 35 | | 33 | | 25 | |
| | 150 | | 250 | | 350 |

IDLING SPEED CONTROL SYSTEM FOR INTERNAL COMBUSTION ENGINES

BACKGROUND OF THE INVENTION

This invention relates to an idling speed control system for internal combustion engines, and more particularly to a system of this kind which is capable of stabilizing the rotational speed of the engine at idle by controlling the quantity of intake air supplied to the engine.

An internal combustion engine for automotive vehicles is so constructed that the output power and rotational speed thereof are controlled by controlling the quantity of intake air by the use of a throttle valve. In an engine having a carburetor, a throttle valve is generally mounted in the carburetor and so arranged that the opening thereof can be adjusted by an idling opening adjusting bolt screwed in the body of the carburetor. The idling opening of the throttle valve is adjusted, by the use of the idling opening adjusting bolt, to a suitable value at the time of manufacture or maintenance operation of the engine, and therefore the idling opening thus set by the bolt cannot be arbitrarily further adjusted by a driver during operation of the engine.

Since the idling opening of the throttle valve thus has an adjusted fixed value, the rotational speed of the engine is kept constant, if the load on the engine does not vary during idling operation of the engine. However, if the load on the engine varies due to variations in the load on the generator for charging the battery or in the load on the automatic transmission, or due to switching-on and -off of the compressor in the air-conditioner, the rotational speed of the engine correspondingly varies, which makes it difficult to obtain stable idling speed and sometimes results in engine stalling. It is therefore necessary to set a desired idling speed at such a high value as to keep the engine always operating in a stable idling condition, without being influenced by the variations in the engine load. However, if the desired idling speed is set at such a high value, there can occur problems such as occurrence of large noise during idling operation of the engine, and increase of the fuel consumption.

Further, as shown in FIG. 6, at so-called snap deceleration, e.g. if the accelerating pedal is stepped on to abruptly increase the engine rotational speed to 1500 rpm when the engine is operating at an idling speed, e.g. 750 rpm and then the accelerator pedal is suddenly released from its stepped-on state, the engine rotational speed can suddenly drop below the desired idling speed, which renders the engine operation unstable and sometimes causes engine stalling.

To solve such problems, it has conventionally been proposed e.g. by Japanese Provisional patent Publication No. 58-155255 to control the throttle valve opening during idling operation of the engine by the use of a pulse motor. Another method of controlling the idling speed of the engine has been proposed by Japanese Provisional patent Publication No. 59-155547, which comprises detecting the rotational speed of the engine by the use of a predetermined crank angle signal, calculating the difference between the detected engine rotational speed and a desired idling speed, and controlling the quantity of intake air bypassing the throttle valve by controlling the duty ratio of a control valve with a control signal corresponding to the difference thus calculated, so as to attain the desired idling speed.

The above proposed methods, however, require complicated control systems as well as expensive control devices and control valves, and thereby are not practical.

SUMMARY OF THE INVENTION

It is an object of the invention to provide an idling speed control system which is simple in construction and can be manufactured at a low cost.

It is a further object of the invention to mitigate the rate of decrease of the engine rotational speed at snap deceleration to thereby prevent unstable engine operation and engine stalling.

According to the invention, the foregoing object is attained by providing an idling speed control system for controlling idling rotational speed of an internal combustion engine having an intake passage and a throttle valve arranged therein, comprising: vacuum-operated actuator means having a vacuum chamber, and a diaphragm defining the vacuum chamber and operatively connected to the throttle valve for controlling opening and closing thereof in response to pressure in the vacuum chamber; change-over control valve means operatively connected to the vacuum-operated actuator means for supplying the vacuum chamber, selectively, with a first control pressure for opening the throttle valve and a second control pressure for closing the throttle valve; and electronic control means operatively connected to the engine and the change-over control valve means, the electronic control means being adapted to effect control of the idling rotational speed of the engine by generating an on-off control pulse signal having a period corresponding to rotational speed of the engine, one of on-period and off-period of the on-off control pulse signal having a predetermined constant value, supplying the change-over control valve means with the on-off control pulse signal, in response to which the change-over control valve means supplies the vacuum chamber of the vacuum-operated actuator means, selectively, with the first control pressure and the second control pressure, the electronic control means being adapted to determine the rotational speed of the engine and a rate of decrease in the rotational speed of the engine, and halt the control for a predetermined period of time when the determined rotational speed of the engine falls within a predetermined range of the rotational speed of the engine and at the same time the determined rate of decrease in the engine rotational speed falls within a predetermined range of the rate of decrease in the engine rotational speed.

Preferably, the predetermined period of time is set to a larger value as the determined rotational speed of the engine is higher.

Also preferablv, the predetermined period of time is set to a larger value as the determined rate of decrease in the engine rotational speed is larger.

Further preferably, the electronic control means is adapted to execute the halting of the control when the rotational speed of the engine has dropped across each of a plurality of predetermined values, and at the same time the rate of decrease in the engine rotational speed falls within a predetermined range corresponding to the each of the plurality of predetermined values across which the engine rotational speed has dropped.

The above and other objects, features and advantages of the invention will be more apparent from the ensuing detailed description taken in conjunction with the accompanying drawings.

BRIEF DESCRIPTION OF THE DRAWINGS

FIG. 3 is a graph showing a characteristic of the control of the engine rotational speed at snap deceleration of the engine;

FIG. 4 is a view showing a table of the relationship between the rotational speed of the engine, rate of decrease in the engine rotational speed, and the time period for which the solenoid valve is deenergized;

FIG. 6 is a graph showing a characteristic of change of the rotational speed of the engine in a snap decelerating condition.

DETAILED DESCRIPTION

The invention will now be described in detail with reference to the drawings showing an embodiment thereof.

Figure 1:
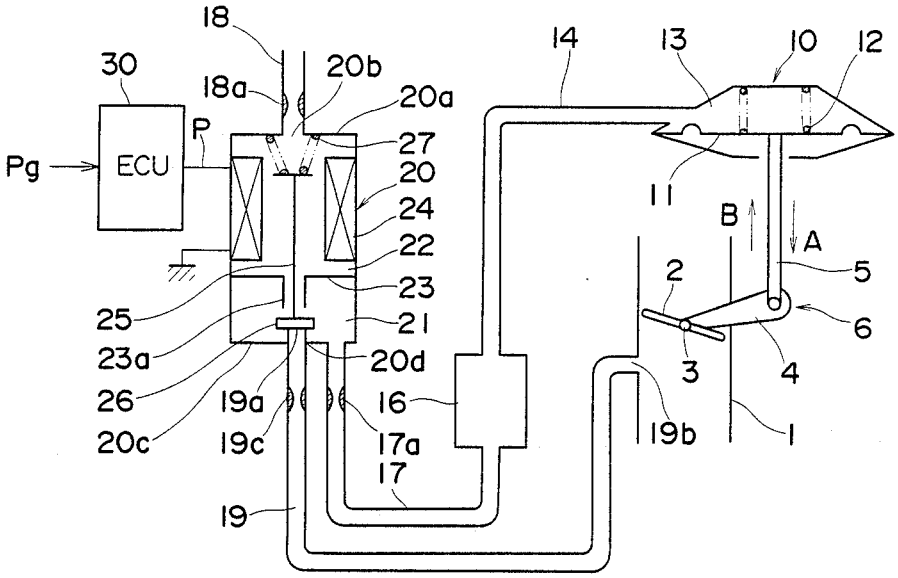
FIG. 1 is a schematic view illustrating the whole arrangement of an idling speed control system for internal combustion engines according to an embodiment of the invention.

Referring now to FIG. 1, there is illustrated the whole arrangement of an idling speed control system according to the invention. Reference numeral 1 designates an intake pipe, one end of which is connected to intake ports, not shown, of the engine, and the other end of which is connected to the atmosphere via an air cleaner, not shown. Arranged in the intake pipe 1 is a throttle valve 2 which is connected to a vacuum-operated actuator 10 by way of a link mechanism 6 comprising a lever 4 and a rod 5, and the opening of the throttle valve 2 is adjusted by the actuator 10 so that the engine rotational speed approaches a desired idling speed when the engine is operating in an idling condition.

The vacuum-operated actuator 10 is a push type which comprises a diaphragm 11, a vacuum chamber 13, and a coil spring 12. The vacuum chamber 13 communicates with a change-over control valve (hereinafter simply called "the solenoid valve") 20 comprising e.g. a frequency solenoid valve, through a surging tank 16 for suppressing fluctuations in pressure and a passage 17. On the other hand, the diaphragm 11 is connected to the rod 5.

The solenoid valve 20 is an on-off type, of which a solenoid 24 is energized or deenergized in response to a control signal from an electronic control unit (hereinafter simply called "the ECU") 30. When the solenoid 24 is energized, a vacuum or negative pressure produced in the intake pipe 1 is introduced into the vacuum chamber 13 in the actuator 10, and when the solenoid 24 is deenergized, the atmospheric pressure is introduced into the vacuum chamber 13.

To be specific, the solenoid valve 20 has two chambers 21 and 22 separated by a partition wall 23 and communicating with each other through a communication port **23*a* provided centrally of the partition wall 23. The chamber 22 also communicates with the atmosphere by way of a passage 18 connected to a hole 20*d* formed in an end wall 20*a* of the chamber 22. One end 19*a* of a passage 19 is hermetically inserted into a hole 20*d* formed in an end wall 20*c* of the chamber 21 centrally thereof. The open end 19*a* of the passage 19 projects into the chamber 21 and is opposed to the communication port 23*a* in the partition wall 23 with a predetermined gap, and the other open end 19*b* communicates with the intake pipe 1 at a predetermined location downstream of the throttle valve 2**.

A plunger 25 axially movably extends through the solenoid 24 which is accommodated within the chamber 22 in the solenoid valve 20, with one end thereof slidably projected into the chamber 21 through the communication port **23*a*. A valve body 26 is secured to a face of the projected end of the plunger 25, and arranged between the communication port 23*a* and the open end 19*a* of the passage 19 such that it selectively closes the opposed open end of the communication port 23*a* or the open end 19*a* of the passage 19 in response to movement of the plunger 25. A return spring 27 is interposed in a contracted state between the other end of the plunger 25 and the opposed end wall 20*a* of the solenoid 20 such that it urges the plunger 25 in the direction in which the plunger projects into the chamber 21. The valve body 26 is urged against the open end 19*a* of the passage 19 by the return spring 27 when the solenoid 24 is deenergized, thereby closing the passage 19. The solenoid valve 24 has one connection terminal electrically connected to the ECU 30**, and the other connection terminal grounded.

Incidentally, the passages 17, 18, and 19 communicating with the solenoid valve 20 are provided therein respectively with restrictions **17*a*, 18*a*, and 19*c* at predetermined locations thereof for restricting fluctuations in pressure within respective passages which are to be introduced into the chambers 21, 22 of the solenoid 20**.

Figure 2:
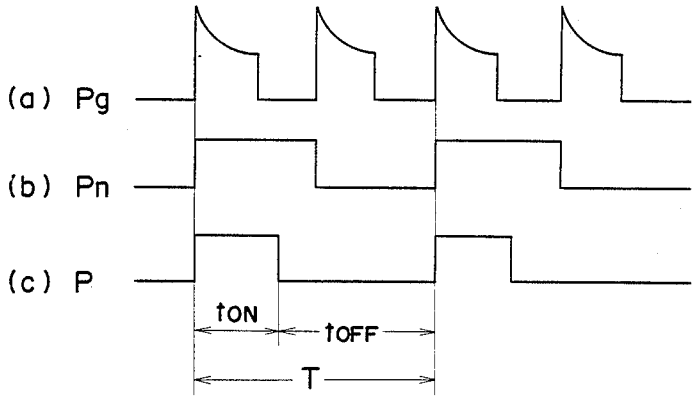
FIG. 2 is a graph showing waveforms of a pulse signal P generated from an electronic control unit appearing in FIG. 1 on the basis of the period of a control pulse signal Pg for on-off control of a solenoid valve of the idling speed control system, as well as corresponding processed pulses.

Further supplied to the ECU 30 is a signal generated in synchronism with the engine rotation, e.g. an ignition pulse signal Pg [(a) of FIG. 2] from the primary winding in the ignition coil.

The ECU 30 produces an on-off control pulse signal P for on-off controlling the solenoid valve 20 on the basis of the ignition pulse signal Pg inputted thereto and supplies same to the solenoid valve 24.

Reference is now made to the operation of the idling speed control system constructed as above.

When the solenoid 24 is deenergized by the control pulse signal P supplied from the ECU 30, the plunger 25 is biased toward the open end **19*a* by the urging force of the spring 27 so that the valve body 26 closes the open end 19*a* and opens the communication port 23*a*, whereby the atmosphere is introduced into the vacuum chamber 13 in the vacuum-operated actuator 10. Consequently, the diaphragm 11 of the actuator 10 is displaced in the direction of the arrow A in FIG. 1, by the urging force of the coil spring 12. On the other hand, when the solenoid 24 is energized by the control signal P, the plunger 25 is attracted by a magnetic force produced by the solenoid 24 and overcoming the urging force of the spring 27, to close the communication port 23*a* and open the open end 19*a* of the passage 19, whereby negative pressure developed in the intake pipe 1 is introduced into the vacuum chamber 13. As a result, the diaphragm 11 arranged in the vacuum-operated actuator 10 is displaced in the direction of the arrow B, that is, in the opposite direction to that in which the diaphragm 11 is displaced when the solenoid 24** is deenergized.

In this way, the opening of the throttle valve 2 is selectively controlled to a larger degree or to a smaller degree by controlling the duty ratio of the solenoid 24 of the solenoid valve 20 by the use of the control signal P supplied from the ECU 30.

Reference is now made to how the control signal P is generated from the ECU 30.

The ECU 30 is supplied with a signal generated in synchronism with the engine rotation, e.g. the ignition pulse signal Pg from the primary winding of the ignition coil [(a) of FIG. 2]. The ignition pulse signal Pg has its frequency divided by a predetermined number N, e.g. two, to obtain a pulse signal Pn [(b) of FIG. 2]. Then, the ECU 30 generates the control pulse signal P [(c) of FIG. 2] which is at a high level for a predetermined fixed time period tON from the leading edge of each pulse of the pulse signal Pn.

The pulse repetition period T of the control pulse signal P is equal to that of the pulse signal Pn, wherein the solenoid 24 is energized for the predetermined fixed time period tON and then deenergized for a time period tOFF (=T−tON). Therefore, the duty ratio of the solenoid valve 20 varies in response to the engine rotational speed Ne. To be specific, as described above, the on-period or pulse duration tON of the control pulse signal P [(c) of FIG. 2] is set at a predetermined constant value, and the off-period tOFF becomes longer as the engine rotational speed Ne decreases, and vice versa.

Consequently, as the engine rotational speed Ne decreases, the opening period of the communication port 23*a* in the solenoid 20 which communicates with the atmosphere becomes longer, in response to which the negative pressure in the vacuum chamber 13 becomes smaller, so that the diaphragm 11 is displaced by the urging force of the spring 12 to move the rod 5 along the arrow A and thereby open the throttle valve 2. Then, the engine rotational speed Ne increases according to the longer opening action of the throttle valve 2. On the other hand, as the engine rotational speed Ne increases, the opening period of the communication port 23*a* in the solenoid valve 20 becomes shorter, and then the negative pressure PB in the intake pipe becomes higher. As a result, a high negative pressure is introduced into the vacuum chamber 13 of the vacuum-operated actuator 10 and accordingly the negative pressure therein becomes larger, so that the diaphragm 11 is attracted by the higher negative pressure in the vacuum chamber 13 against the urging force in the spring 12 to pull the rod 5 back along the arrow B and thereby close the throttle valve 2. Then, the engine rotational speed decreases according to the closing action of the throttle valve 2.

As described above, when the engine rotational speed Ne at engine idle is high, the ratio of the on-period (constant value) tON of the control pulse signal P to the period thereof becomes larger, the negative pressure for operating the diaphragm 11 becomes larger, and accordingly the opening of the throttle valve 2 is decreased. On the contrary, when the engine rotational speed Ne at engine idle is low, the ratio of the on-period tON of the pulse signal P becomes smaller, the operating negative pressure becomes smaller, and accordingly the opening of the throttle valve 2 is increased.

Thus, according to the invention it is not necessary to calculate the duty ratio of the control signal for on-off controlling the solenoid valve 20 and nor necessary to provide expensive control devices such as a pulse motor. The control system according to the invention has a simple structure but is capable of achieving proportional feedback control of the idling speed Ne in response to the engine rotational speed.

Reference is now made to how the ECU 30 controls the rotational speed Ne of the engine at deceleration.

The ECU 30 calculates the engine rotational speed Ne by counting clock pulses generated within each time interval between two adjacent pulses of the ignition pulse signal Pg inputted thereto. When the engine rotational speed Ne drops across respective predetermined rotational speed values, e.g. 1250 rpm, 1000 rpm, and 850 rpm during decelerating operation of the engine, the ECU 30 deenergizes the solenoid 24 of the solenoid valve 20 with priority to the aforedescribed idling speed feedback control operation for a predetermined time period ΔT (hereinafter called "one shot time") by inhibiting the control pulse signal P from being supplied to the solenoid valve 20, to introduce the atmospheric air into the vacuum chamber 13 so as to open the throttle valve 2, to thereby avoid a sudden or abrupt drop in the engine rotational speed Ne.

Further, the ECU 30 calculates a rate of decrease −ΔNe in the rotational speed Ne of the engine when the rotational speed Ne drops across each of the above-mentioned predetermined rotational speed values and sets the one shot time ΔT to a value corresponding to the calculated rate of decrease −ΔNe. In practice, the one shot time ΔT is set to different values in accordance with respective regions of the rate of decrease in the engine rotational speed. To be specific, the ECU 30 sets the one shot time ΔT to a larger value as the engine is operating at a higher speed or as the rate of decrease in the engine rotational speed is larger. An example of one shot time values ΔT is shown in the table of FIG. 4 with respect to the rate of decrease −ΔNe in the engine rotational speed and the engine rotational speed Ne.

Figure 5:
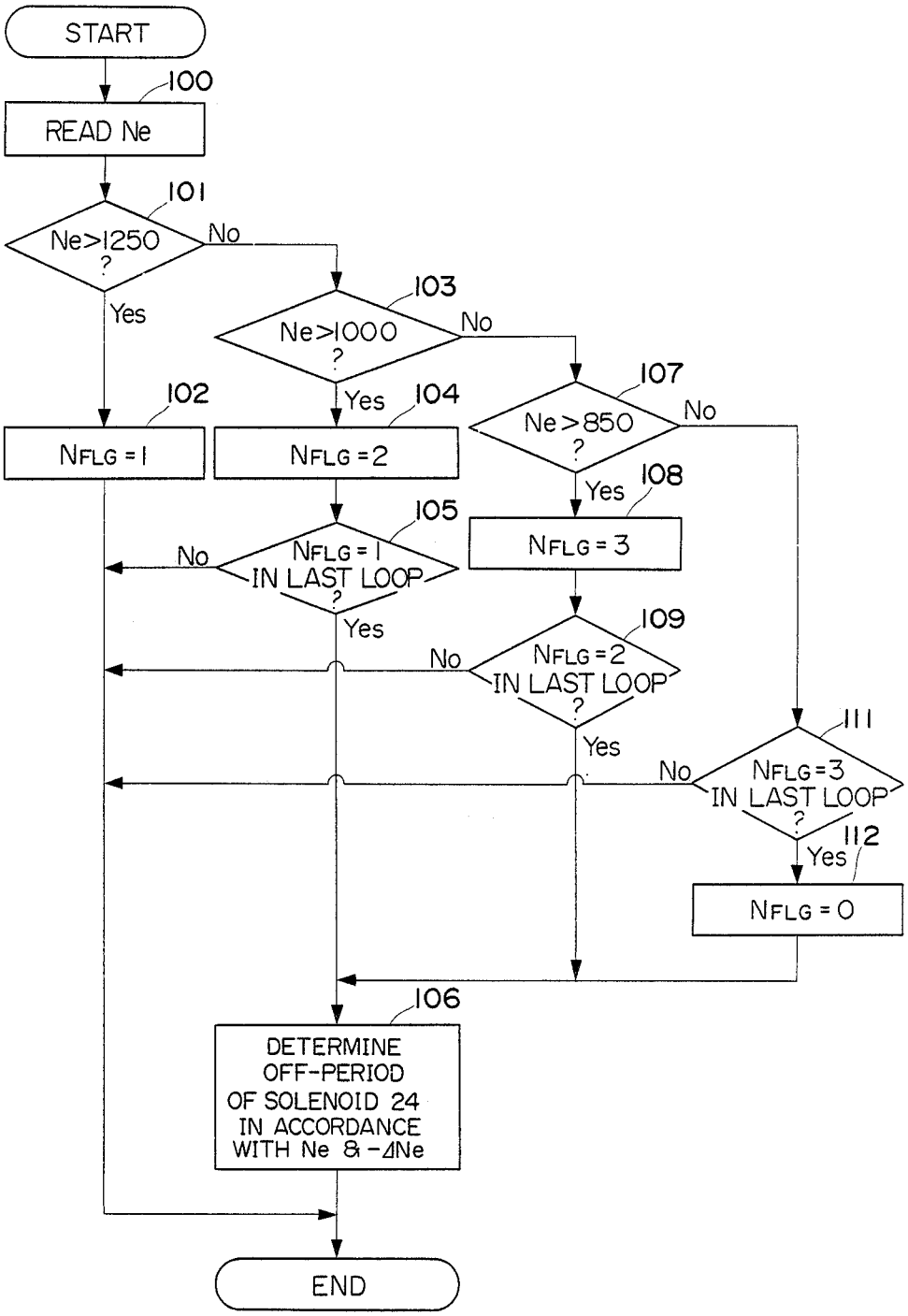
FIG. 5 is a flowchart showing a program routine for controlling the rotational speed of the engine in nap decelerating conditions.

A manner of controlling the idling speed of the engine during at snap deleceration will now be explained with reference to FIG. 3 to FIG. 5. The program of FIG. 5 is executed in synchronism with a predetermined timing signal whose pulses are generated at a time interval of 100 msec, for instance.

Let it now assumed, for example, that as shown in FIG. 3, when the engine is operating in an idling region, e.g. at 750 rpm, the accelerator pedal is stepped on at a time t1 and suddenly released at a time t2 at which the engine rotational speed Ne has increased e.g. to 1500 rpm. The ECU 30, as described above, counts clock pulses generated between two adjacent pulses of the ignition pulse signal Pg, calculates the engine rotational speed Ne each time each pulse of the above-mentioned predetermined timing signal is generated, and temporarily store the calculated Ne value in a memory, not shown, at the step 100 in FIG. 5. Then, it is determined at the step 101 whether or not the stored value of the engine rotational speed Ne is higher than a predetermined value (e.g. 1250 rpm). If the answer to the question of the step 101 is affirmative or yes, a flag NFLG is set to 1 at the step 102, followed by termination of the program. The value 1 set in the flag NFLG indicates that the engine rotational speed Ne is in a rotational speed region above 1250 rpm.

If the answer at the step 101 is negative or no, it is determined at the step 103 whether or not the engine rotational speed Ne is higher than another predetermined value (e.g 1000 rpm). If the answer to the question of the step 103 is affirmative or yes, the flag NFLG is set to 2 at the step 104 to indicate that the engine rotational speed Ne is in a region above 1000 rpm. Then, the program proceeds to the step 105 wherein it is determined whether or not the flag NFLG was set to 1 in the immediately preceding or last loop. If the answer to the question at the step 105 is negative or no, that is, if the engine rotational speed Ne has not dropped from the region above 1250 rpm, the program is terminated. On the other hand, if the answer to the question at the step 105 is affirmative or yes, that is, if the engine rotational speed has dropped from the region above 1250 rpm, the program proceeds to the step 106 wherein the deenergization period (off-period) of the solenoid 24 i.e. the one shot time ΔT is determined in accordance with the engine rotational speed Ne and the rate of decrease −ΔNe in the engine rotational speed Ne from the table of FIG. 4, followed by termination of the program. The rate of decrease −ΔNe is obtained as a difference between an engine rotational speed value Ne−1 calculated at an immediately preceding pulse of the aforementioned predetermined timing signal and a value Ne calculated at a present pulse of same. For example, as shown in FIG. 4, if the rate of decrease −ΔNe is in a region between 20 rpm and 25 rpm, the one shot time ΔT is set to 300 msec, when the engine rotational speed Ne is in a region between 1250 rpm and 1000 rpm at 1250 rpm.

The ECU 30 inhibits the control pulse signal P [(c) of FIG. 2] from being outputted for the determined one shot time period T (=300 msec). Then, the solenoid 24 is deenergized so that the atmospheric air is introduced into the vacuum chamber 13 of the vacuum-operated actuator 10 to open the throttle valve 2, whereby the engine rotational speed Ne slowly decreases without suddenly dropping. This valve opening control is executed with priority to the idling speed feedback control operation.

If the answer to the question at the step 103 is negative or no, that is, if the engine rotational speed Ne is below 1000 rpm, the program proceeds to the step 107 wherein a determination is made as to whether or not the engine rotational speed Ne is above 850 rpm. If the answer to the question of the step 107 is affirmative or yes, the flag NFLG is set to 3 at the step 108 to indicate that the engine rotational speed Ne is in a region above 850 rpm, followed by the program proceeding to the step 109. It is determined at the step 109 whether or not the flag NFLG was set at 2 in the immediately preceding loop, that is, if the engine rotational speed Ne has dropped from the region above 1000 rpm. If the answer to the question of the step 109 is affirmative or yes, that is, if the engine rotational speed Ne has dropped from the region above 1000 rpm, the program proceeds to the step 106 wherein the one shot time or deenergization period ΔT of the solenoid 24 is determined in accordance with the engine rotational speed Ne and the rate of decrease −ΔNe in the engine rotational speed, followed by termination of the program. For example, according to the FIG. 4 table, if the rate of decrease −ΔNe is in a region between 25 rpm and 33 rpm, the one shot time ΔT is set to 200 msec, when the engine rotational speed Ne is in a region between 1000 rpm and 850 rpm.

The ECU 30 inhibits the control pulse signal P from being outputted for the determined one shot time ΔT (=200 msec). Then, in the same manner as described above, the throttle valve 2 is opened so that the engine rotational speed Ne slowly decreases. On the other hand, if the answer at the step 109 is negative or no, the program is terminated without executing the decelerating control operation.

If the answer to the question of the step 107 is negative or no, the program proceeds to the step 111 wherein it is determined whether or not the flag NFLG was set to 3 in the immediately preceding loop. If the answer to the question of the step 111 is affirmative or yes, that is, if the engine rotational speed Ne has dropped from the region above 850 rpm, the flag NFLG is reset at the step 112, and then the program proceeds to the step 106 wherein the deenergization period ΔT of the solenoid 24 is determined in accordance with the engine rotational speed Ne and the rate of decrease −ΔNe in the engine rotational speed, followed by termination of the program. For example, according to the FIG. 4 table, if the rate of decrease −ΔNe is in a region between 25 rpm and 28 rpm, the one shot time ΔT is set to 30 msec, when the engine rotational speed Ne is in a region below 850 rpm.

The ECU 30 inhibits the control pulse signal P from being outputted for the determined one shot time ΔT (=30 msec to open the throttle valve 2, so that the engine rotational speed Ne slowly decreases. On the other hand, if the answer at the step 111 is negative or no, the program is terminated without executing the snap decelerating control operation.

As described above, when the engine rotational speed Ne drops across the respective predetermined rotational speed values, i.e. 1250 rpm, 1000 rpm, and 850 rpm, during snap decelerating operation, the throttle valve 2 is opened for the one shot time ΔT determined in accordance with the engine rotational speed Ne and the rate of decrease −ΔNe in the engine rotational speed, wherein the engine rotational speed Ne to be controlled is divided into 3 regions in each of which mitigation of a drop in the engine rotational speed Ne is carried out. In this way, the rotational speed Ne of the engine at snap deceleration can be prevented from largely dropping below a desired idling speed, whereby the engine can stably operate.

Incidentally, a further advantage of the idling control system of the invention is that by virtue of the use of the vacuum-operated actuator using a diaphragm and adapted to open the throttle valve by the atmospheric pressure (a first control pressure), the throttle valve can be opened to a larger degree when the engine is operating at a high altitude than when the engine is operating at a low altitude, since the operating negative pressure acting upon the actuator becomes smaller with a decrease in the intake pipe vacuum (a second control pressure) at such a high altitude, enabling to increase the idling speed at a high altitude higher than that at a low altitude and to thereby stabilize the idling operation of the engine.

What is claimed is:

1. An idling speed control system for controlling idling rotational speed of an internal combustion engine having an intake passage and a throttle valve arranged therein, comprising;

vacuum-operated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve; and electronic control means operatively connected to said engine and said change-over control valve means, said electronic control means being adapted to effect control of the idling rotational speed of the engine by generating an on-off control pulse signal having a period corresponding to rotational speed of said engine, one of on-period and off-period of said on-off control pulse signal having a predetermined constant value, and supplying said change-over control valve means with said on-off control pulse signal, in response to which said change-over control valve means supplies said vacuum chamber of said vacuum-operated actuator means, selectively, with said first control pressure and said second control pressure, said electronic control means being adapted to determine the rotational speed of said engine and a rate of decrease in the rotational speed of said engine, and halt said control for a predetermined period of time when the determined rotational speed of said engine falls within a predetermined range and at the same time the determined rate of decrease in the engine rotational speed falls within a predetermined range, said predetermined period of time being set depending on said predetermined range of the rotational speed of said engine and said predetermined range of the rate of decrease in the engine rotational speed, to thereby cause said change-over control valve means to supply said vacuum chamber of said vacuum-operated actuator means with said first control pressure for opening said throttle valve for said predetermined period of time.

2. An idling speed control system for controlling idling rotational speed of an internal combustion engine having an intake passage and a throttle valve arranged therein, comprising;

vacuum-operated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve; and electronic control means operatively connected to said engine and said change-over control valve means, said electronic control means being adapted to effect control of the idling rotational speed of the engine by generating an on-off control pulse signal having a period corresponding to rotational speed of said engine, one of on-period and off-period of said on-off control pulse signal having a predetermined constant value, and supplying said change-over control valve means with said on-off control pulse signal, in response to which said change-over control valve means supplies said vacuum chamber of said vacuum-operated actuator means, selectively, with said first control pressure and said second control pressure, said electronic control means being adapted to determine the rotational speed of said engine and a rate of decrease in the rotational speed of said engine, and halt said control for a predetermined period of time when the determined rotational speed of said engine falls within a predetermined range and at the same time the determined rate of decrease in the engine rotational speed falls within a predetermined range, said predetermined period of time being set to a larger value as the determined rotational speed of said engine is higher;

to thereby cause said change-over control valve means to supply said vacuum chamber of said vacuum-operated actuator means with said first control pressure for opening said throttle valve for said predetermined period of time.

3. An idling speed control system for controlling idling rotational speed of an internal combustion engine having an intake passage and a throttle valve arranged therein, comprising:

vacuum-operated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve; and electronic control means operatively connected to said engine and said change-over control valve means, said electronic control means being adapted to effect control of the idling rotational speed of the engine by generating an on-off control pulse signal having a period corresponding to rotational speed of said engine, one of on-period and off-period of said on-off control pulse signal having a predetermined constant value, supplying said change-over control valve means with said on-off control pulse signal, in response to which said change-over control valve means supplies said vacuum chamber of said vacuum-operated actuator means, selectively, with said first control pressure and said second control pressure, said electronic control means being adapted to determine the rotational speed of said engine and a rate of decrease in the rotational speed of said engine, and halt said control for a predetermined period of time when the determined rotational speed of said engine has dropped across each of a plurality of predetermined values and at the same time the determined rate of decrease in the engine rotational speed falls within a predetermined range corresponding to said plurality of predetermined values across which the engine rotational speed has dropped, to thereby cause said change-over control valve means to supply said vacuum chamber of said vacuum-operated actuator means with said first control pressure for opening said throttle valve for said predetermined period of time.

4. An idling speed control system for controlling idling rotational speed of an internal combustion engine having an intake passage and a throttle valve arranged therein, comprising:

vacuum-operated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve; and electronic control means operatively connected to said engine and said change-over control valve means, said electronic control means being adapted to effect control of the idling rotational speed of the engine by generating an on-off control pulse signal having a period corresponding to rotational speed of said engine, one of on-period and off-period of said on-off control pulse signal having a predetermined constant value, and supplying said change-over control valve means with said on-off control pulse signal, in response to which said change-over control valve means supplies said vacuum chamber of said vacuum-operated actuator means, selectively, with said first control pressure and said second control pressure, said electronic control means being adapted to determine the rotational speed of said engine and a rate of decrease in the rotational speed of said engine at the same time, determine within which range of a plurality of predetermined ranges of the engine rotational speed the determined rotational speed falls, determined within which range of a plurality of predetermined ranges of the rate of decrease in the engine rotational speed the determined rate of decrease in the engine rotational speed falls, set a predetermined period of time in accordance with a combination of said range of the engine rotational speed within which the determined rotational speed falls and said range of the rate of iecrease in the engine rotational speed within which the determined rate of decrease in the engine rotational speed falls, and halt said control for said predetermined period of time, to thereby cause said change-over control valve means to supply said vacuum chamber of said vacuum-operated actuator means with said first control pressure for opening said throttle valve for said predetermined period of time.

5. An idling speed control system as claimed in claim 1, wherein said predetermined period of time is set to a larger value as the determined rotational speed of said engine is higher.

6. An idling speed control system as claimed in claim 1 or claim 5, wherein said predetermined period of time is set to a larger value as the determined rate of decrease in the engine rotational speed is larger.

7. An idling speed control system as claimed in claim 1 or 5, wherein said electronic control means is adapted to execute said halting of said control when the rotational speed of said engine has dropped across each of a plurality of predetermined values, and at the same time the rate of decrease in the engine rotational speed falls within a predetermined range corresponding to the each of said plurality of predetermined values across which the engine rotational speed has dropped.

8. An idling speed control system as claimed in claim 6, wherein said electronic control means is adapted to execute said halting of said control when the rotational speed of said engine has dropped across each of a plurality of predetermined values, and at the same time the rate of decrease in the engine rotational speed falls within a predetermined range corresponding to the each of said plurality of predetermined values across which the engine rotational speed has dropped.

* * * * *